US009669622B2

(12) United States Patent
Yokoyama et al.

(10) Patent No.: US 9,669,622 B2
(45) Date of Patent: Jun. 6, 2017

(54) LIQUID DETECTING UNIT AND LIQUID JETTING DEVICE

(71) Applicant: SEIKO EPSON CORPORATION, Tokyo (JP)

(72) Inventors: Hidetoshi Yokoyama, Nagano (JP); Masaki Tsukida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/980,016

(22) Filed: Dec. 28, 2015

(65) Prior Publication Data

US 2016/0271941 A1 Sep. 22, 2016

(30) Foreign Application Priority Data

Mar. 17, 2015 (JP) ..... 2015-053026

(51) Int. Cl.
*H01H 35/18* (2006.01)
*B41J 2/045* (2006.01)

(52) U.S. Cl.
CPC ..... *B41J 2/04555* (2013.01); *B41J 2/04586* (2013.01)

(58) Field of Classification Search
None
See application file for complete search history.

(56) References Cited

U.S. PATENT DOCUMENTS 5,775,164 A * 7/1998 Kishi ..... B41J 2/17566 73/304 R
6,023,971 A * 2/2000 Swartz ..... G01C 9/06 73/301

FOREIGN PATENT DOCUMENTS

JP 03-275360 A 12/1991
JP 10-076674 A 3/1998

* cited by examiner

*Primary Examiner* — Alejandro Valencia
(74) *Attorney, Agent, or Firm* — Global IP Counselors, LLP

(57) ABSTRACT

Provided is a liquid detecting unit and a liquid jetting device that avoid generation of air bubbles and deposit of the components of ink due to electrolysis of the liquid when detecting liquid information. The liquid detecting unit is provided with an alternating current generation circuit for generating an alternating current to be applied to the liquid, a detection output generation unit for generating a detection output for detecting the liquid information based on a potential of a first connection point in the alternating current generation circuit and a potential of a second connection point in the alternating current generation circuit, and a detection unit for detecting the liquid information based on the detection output.

13 Claims, 7 Drawing Sheets

PWM OUTPUT 42
VDD
VSS
A
t1
t2
t3
t4

PWM OUTPUT 42
VDD
VSS
t1
T1
T2
T1

DETECTION VOLTAGE V1
VDD
VSS
Vd

POTENTIAL V2
VDD
THRESHOLD
VSS

DETECTION VOLTAGE V1
VDD
VSS

OUTPUT 56
VDD
VSS

DETECTION OUTPUT 57
VDD
VSS

LIQUID DETECTING UNIT AND LIQUID JETTING DEVICE

BACKGROUND

1. Technical Field

The present invention relates to a liquid detecting unit and a liquid jetting device.

2. Related Art

In recent years, as an example of liquid jetting devices, inkjet printers are known. An inkjet printer can perform printing on a printing medium such as printing paper by discharging ink, as an example of liquid, from a print head onto the printing medium. Moreover, the inkjet printer is provided with an ink tank as a liquid container for storing ink, and performs printing by supplying the stored ink to the print head. As an inkjet printer of this type, one provided with a liquid detecting unit for detecting the residual amount of ink stored in an ink tank, which is one piece of ink information, is known (for example, see JP-A-3-275360).

There have been cases where in a liquid detecting unit, an electric current is caused to flow through ink in an ink tank in order to detect the ink residual amount. In this case, due to the ink being electrolyzed by the direct electrical current flowing therethrough, air bubbles can be generated, and the components of the ink can be deposited on an electrode. In this state, there has been a problem in that the air bubbles or the deposited components of the ink are mixed with the ink, are conveyed to a print head, and then clog the nozzle of the print head, thereby adversely influencing ink discharge. The liquid detecting unit in JP-A-3-275360 is provided with a voltage restriction unit, and a pulse voltage is applied between a plurality of electrodes. A means for accordingly detecting the ink residual amount while suppressing the electric energy to be applied and avoiding electrolysis is suggested. However, JP-A-3-275360 does not disclose a technical idea that the adverse influence due to electrolysis is avoided by causing an alternating electrical current to flow through the ink, including details of a means for the idea.

Note that an alternating electrical current is a current in which the polarity of a voltage applied between two electrodes periodically changes over time, and the direction of the current flowing between the two electrodes changes in accordance with the change in the voltage. The alternating electrical current is typified by a sine wave alternating electrical current. In this specification, an alternating electrical current including a sine wave alternating electrical current and a non-sine wave alternating electrical current is simply referred to as alternating current.

SUMMARY

The present invention has been made to solve at least a portion of the above-described problems and can be realized in the following aspects or application examples.

Application Example 1

A liquid detecting unit according to the invention is a liquid detecting unit for detecting liquid information regarding liquid stored in a liquid container, the liquid detecting unit including: an alternating current generation circuit for generating an alternating current to be applied to the liquid; a detection output generation unit for generating a detection output for detecting the liquid information based on a potential of a first connection point in the alternating current generation circuit and a potential of a second connection point in the alternating current generation circuit; and a detection unit for detecting the liquid information based on the detection output.

According to this application example, an alternating electrical current is applied to a liquid by the alternating current generation circuit. Therefore, a direct electrical current does not flow in the liquid, and air bubbles are not generated and the components of the liquid are not deposited on the electrode due to electrolysis. Moreover, a detection output for detecting the liquid information is generated based on the potential of a predetermined place in the alternating current generation circuit. Therefore, it is possible to realize the liquid detecting unit capable of generating the detection output that is in accordance with the operations of the alternating current generation circuit, and of avoiding negative influence due to electrolysis. Note that the liquid detecting unit is synonymous with a liquid detection device.

Application Example 2

In the above application example, in the liquid detecting unit, the alternating current generation circuit may be provided with a first conductive member and a second conductive member arranged in the liquid container so as to be immersed in the liquid at least in the case where the liquid container is filled with the liquid, a periodic signal generation unit for generating a predetermined periodic signal, a first resistance whose one end is connected to the first conductive member, a predetermined potential supply unit that is connected to the other end of the first resistance, connects the first conductive member to a predetermined potential that is higher than a reference potential via at least the first resistance in a first time period within one period of the predetermined periodic signal, and cuts off the connection between the first conductive member and the predetermined potential in a second time period within the one period, a reference potential supply unit that is constituted by at least one electric element that is connected between the other end of the first resistance and the reference potential, and connects the first conductive member to the reference potential via the first resistance, and at least one capacitance connected between the second conductive member and the reference potential, wherein the first connection point may be a connection point between the first conductive member and the first resistance, and the second connection point may be a connection point between the predetermined potential supply unit and the first resistance.

According to this application example, the alternating current generation circuit is formed including the first conductive member and the second conductive member that are immersed in liquid, the periodic signal generation unit, the first resistance, the predetermined potential supply unit, the reference potential supply unit, and the at least one capacitance. It is possible to cause an alternating current whose direction of flow is alternately switched between the first time period and the second time period by charging/discharging the at least one capacitance constituting the alternating current generation circuit in the liquid between the first conductive member and the second conductive member. Therefore, negative influence due to electrolysis can be avoided. Moreover, a detection output for detecting the liquid information is generated based on the potentials at both ends of the first resistance constituting the alternating current generation circuit. Therefore, it is possible to realize the liquid detecting unit capable of generating the detection output that is in accordance with the operations of the alternating current generation circuit, and of avoiding negative influence due to electrolysis.

Application Example 3

In the above application example, in the liquid detecting unit, the detection output generation unit may be constituted by at least an analog switch and an integration circuit, the analog switch may be provided with a control terminal and a pair of input/output terminals, the control terminal may be connected to the second connection point, one of the input/output terminals may be connected to the first connection point, the other of the input/output terminals may be connected to the input of the integration circuit, the analog switch may be connected or disconnected based on the potential of the second connection point, and the output of the integration circuit may be the detection output.

According to this application example, the detection output generation unit can be constituted by the analog switch and the integration circuit. Therefore, the detection output generation unit can be constituted by a simple circuit, without using a complicated circuit configuration.

Application Example 4

In the above application example, in the liquid detecting unit, the detection unit may be provided with an A/D converter that performs A/D conversion on the detection output.

According to this application example, the detection unit is provided with the A/D converter. Therefore, the level of the detection output can be accurately grasped by performing A/D conversion on the detection output. As a result, the liquid information is easily detected.

Application Example 5

In the above application example, in the liquid detecting unit, the alternating current generation circuit may be provided with a first terminal that is connectable to the first conductive member and a second terminal that is connectable to the second conductive member, the first conductive member may be connected to the first resistance via the first terminal, and the second conductive member may be connected to the capacitance via the second terminal.

According to this application example, the first conductive member is connected to the first resistance via the first terminal, and the second conductive member is connected to the capacitance via the second terminal. Therefore, reliable connection is realized, and disconnection of the terminal portions from the conductive members can be performed easily.

Application Example 6

In the above application example, in the liquid detecting unit, the alternating current generation circuit may be a p-channel FET in which the predetermined potential supply unit is controlled by the predetermined periodic signal and is brought into a connection state or a cut-off state, and the at least one electric element constituting the reference potential supply unit may be a second resistance.

According to this application example, the predetermined potential supply unit is constituted by the p-channel FET, and the reference potential supply unit is constituted by a resistance. As a result, in the case where the first conductive member and the second conductive member are immersed in liquid, the alternating current generation circuit can perform the following behaviors.

The first time period: the p-channel FET is turned on, and the capacitance connected to the second conductive member is connected to the predetermined potential via the first resistance and the liquid. Therefore, the capacitance is charged.

The second time period: the p-channel FET is turned off, and the capacitance that was charged in the first time period is connected to the reference potential via the liquid, the first resistance and the second resistance. Therefore, the capacitance is discharged.

Furthermore, the predetermined potential supply unit and the reference potential supply unit each can be constituted by one electric element, and thus the alternating current generation circuit can be constituted by a small number of electric elements.

Application Example 7

In the above application example, in the liquid detecting unit, in the alternating current generation circuit, the predetermined potential supply unit and the reference potential supply unit may be constituted on different circuit boards and connected using wiring.

According to this application example, the predetermined potential supply unit and the reference potential supply unit are connected using wiring. Therefore, distributed-arrangement on different circuit boards is possible, and the degree of freedom in board layout designing is increased.

Application Example 8

In the above application example, in the liquid detecting unit, in the alternating current generation circuit, the period of the predetermined periodic signal, the value of the first resistance and the value of the capacitance are determined such that in the case where the first conductive member and the second conductive member are immersed in the liquid, a current always flows from the predetermined potential to the capacitance via the first resistance and the liquid in the first time period.

According to this application example, the alternating current generation circuit performs the following operations. In the case where liquid exists and the first conductive member and the second conductive member are immersed in the liquid, a current always flows from the predetermined potential to the capacitance via the first resistance and the liquid in the first time period. On the other hand, in the case where the first conductive member and the second conductive member are not immersed in the liquid, the current path is shut off because there is no liquid for a current to flow through. Therefore, a current to flow into the capacitance is not generated. Therefore, presence or absence of liquid between the first conductive member and the second conductive member can be detected based on presence or absence of a current flowing to the capacitance in the first time period. In other words, presence or absence of liquid can be detected by detecting the potential difference between both ends of the first resistance, which is caused by a current flowing.

Application Example 9

In the above application example, in the liquid detecting unit, a plurality of liquid containers may be provided, the first conductive member and the second conductive member may be arranged as a pair in each of the plurality of liquid containers, and the alternating current generation circuit may be provided with a selection circuit for selectively connecting one of the first conductive members individually arranged in the plurality of the liquid containers to the first resistance.

According to this application example, the selection circuit selectively connects one of the first conductive members arranged for each of the plurality of liquid containers to the first resistance. Therefore, each of the liquid containers does not need to be provided with all the constituent elements of the alternating current generation circuit. Therefore, the constituent elements of the alternating current generation circuit can be shared, and in the case where a plurality of liquid containers are provided, the cost and the size of the liquid detecting unit can be reduced.

Application Example 10

In the above application example, in the liquid detecting unit, the at least one capacitance may be connected between the second conductive members individually arranged in the plurality of the liquid containers and the reference potential, in the alternating current generation circuit.

According to this application example, the capacitance is individually connected to each of the second conductive members arranged in the plurality of liquid containers. Therefore, the capacitance can be arranged near the liquid container, and thus the wiring between the second conductive member and the capacitance becomes easy, and it is possible to stabilize the electrical property.

Application Example 11

A liquid jetting device according to the invention can inject liquid stored in the liquid container, and is provided with the liquid detecting unit of at least any one of the above application examples 2 to 10 for detecting the liquid information regarding the liquid stored in the liquid container.

According to this application example, the liquid jetting device is provided with the liquid detecting unit that includes the alternating current generation circuit. In the case where liquid exists between the first conductive member and the second conductive member, the alternating current generation circuit can cause an alternating current to flow through the liquid by charging/discharging the capacitance that constitutes the alternating current generation circuit. Therefore, the liquid detecting unit can detect presence or absence of liquid between the first conductive member and the second conductive member by detecting presence or absence of a current flowing to the capacitance. That is, it can be seen that at least one of the first conductive member and the second conductive member is separated from the liquid by detecting that a current does not flow. Meanwhile, the amount of the liquid when at least one of the first conductive member and the second conductive member becomes separated from the liquid serves as a predetermined value that is determined based on the size of the liquid container and the sizes of the conductive members. Therefore, presence or absence of liquid between the first conductive member and the second conductive member can be grasped by detecting presence or absence of a current, and as a result, the amount of the liquid in the liquid container can be detected. Therefore, it is possible to realize the liquid jetting device that enables detection of the amount of liquid as liquid information regarding the liquid in the liquid container without generation of air bubbles or deposit of the components of the liquid on an electrode, which are caused by electrolysis.

Application Example 12

In the above application example, in the liquid jetting device, the liquid container may be provided with an injection port that allows the liquid to be injected, and can be refilled with the liquid.

According to this application example, the liquid container is provided with the injection port that allows liquid to be injected. Therefore, it is possible to realize the liquid jetting device in which the liquid container can be refilled with the liquid from the injection port in the case where the liquid detecting unit detects that the liquid in the liquid container is running out.

Application Example 13

In the above application example, in the liquid jetting device, the alternating current generation circuit may be provided with the first conductive member that is connectable to the first terminal and the second conductive member that is connectable to the second terminal, the liquid container may be detachable from the liquid jetting device, and when the liquid container is mounted in the liquid jetting device, the first conductive member may be connected to the first terminal, and the second conductive member is connected to the second terminal.

According to this application example, when the liquid container is mounted in the liquid jetting device, the first conductive member arranged in the liquid container is connected to the first terminal, and the second conductive member arranged in the liquid container is connected to the second terminal. Therefore, it is possible to realize the liquid jetting device that forms the alternating current generation circuit when the liquid container is mounted.

Application Example 14

In the above application example, in the liquid jetting device, the liquid may be ink for printing, and the liquid jetting device may be an inkjet printer provided with a print head for discharging the ink toward a printing medium and an ink transportation path for transporting the ink from the liquid container to the print head.

According to this application example, the inkjet printer is provided with the liquid detecting unit that includes the alternating current generation circuit. In the case where ink exists between the first conductive member and the second conductive member, the alternating current generation circuit can cause an alternating current to flow through the ink by charging/discharging the capacitance that constitutes the alternating current generation circuit. Therefore, it is possible to realize the inkjet printer that can perform detection of the ink amount without a direct current flowing through the ink and without generation of air bubbles or deposit of the components of the ink on an electrode, which are caused by electrolysis.

DESCRIPTION OF EXEMPLARY EMBODIMENTS

Figure 1:
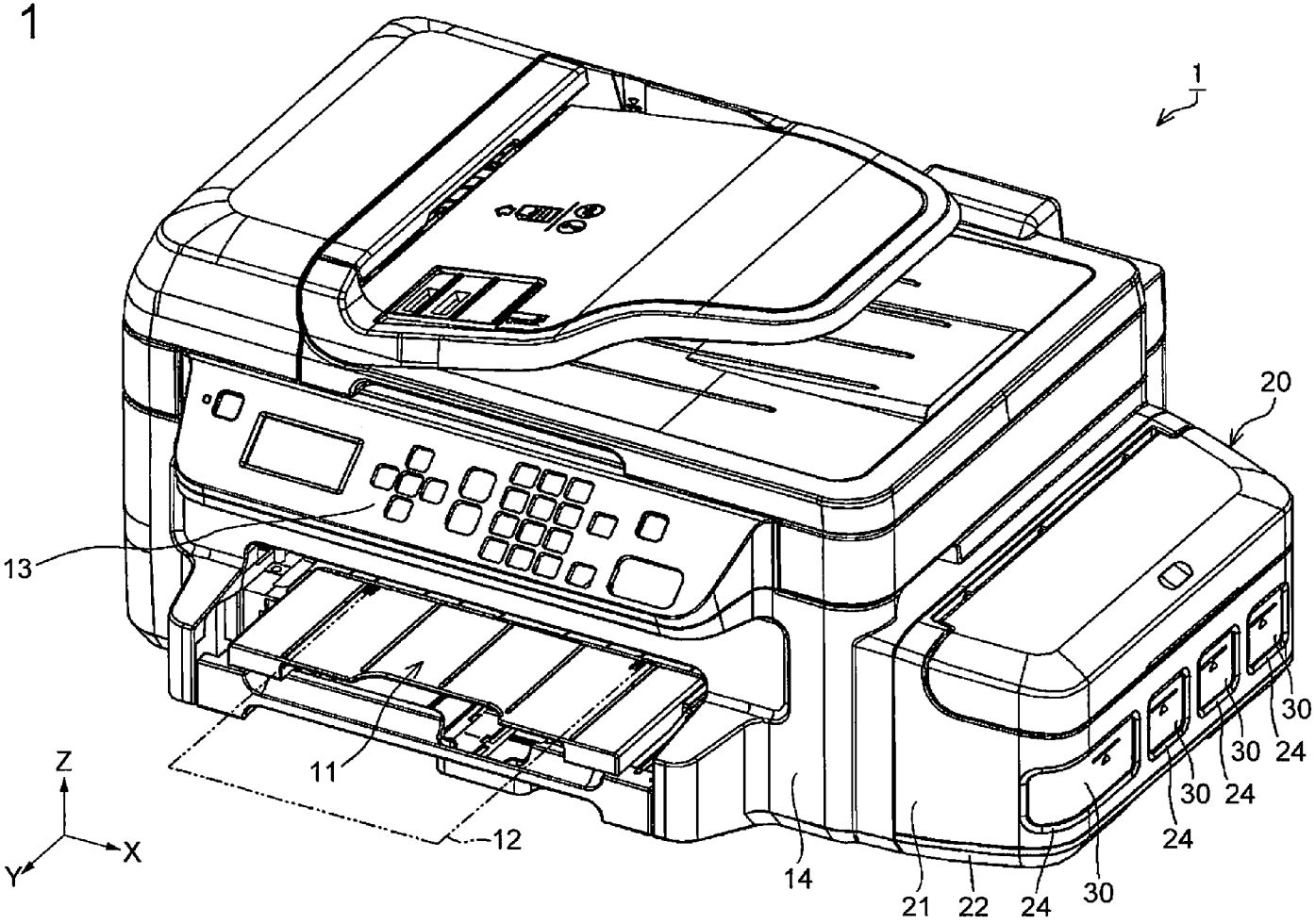
FIG. 1 is a perspective view of an appearance of an inkjet printer to which the present invention is applied.

An embodiment in which the present invention is applied will be described below with reference to the drawings. In the embodiment, as an example of a liquid jetting device to which the present invention is applied, an inkjet printer 1 (hereinafter referred to as printer) will be described. The printer 1 is a printer that performs printing by discharging ink 34 stored in an ink tank 30 from a print head 17 onto a printing medium such as a sheet 12 (see FIGS. 1 and 3). Here, the ink tank 30 corresponds to a liquid container, and the ink 34 corresponds to liquid stored in the liquid container. Note that in the drawings that will be referred to in the following description, some members or portions are indicated on a scale with an aspect ratio that is different from the actual aspect ratio, for convenience of description and illustration.

First Embodiment

Overall Configuration of Printer

First, the overall configuration of the printer 1 will be described with reference to FIG. 1. FIG. 1 is a perspective view of the appearance of the printer 1 to which the present invention is applied. In FIG. 1, X, Y and Z axes, which are coordinates axes that cross orthogonally with one another, are added. Moreover, in figures indicated hereinafter as well, similar X, Y and Z axes are added if necessary. The orientation of an arrow of each of the X, Y and Z axes indicates a plus direction (positive direction), and the orientation opposite to the orientation of the arrow indicates a minus direction (negative direction). In a state where the printer 1 is used, the printer 1 is arranged on a horizontal plane that is defined by the X axis and the Y axis. In a used state of the printer 1, the Z axis is an axis that crosses orthogonally with the horizontal plane, and a −Z axis direction is a vertically downward direction. Moreover, a +Y axis direction side of the printer 1 is referred to as the front side, and a −Y axis direction side is referred to as the rear side.

As shown in FIG. 1, the printer 1 as the liquid jetting device in this embodiment is provided with an ink tank unit 20, an operation unit 13 and a paper discharge unit 11. The printer 1 is further provided with a case 14, and the case 14 constitutes a portion of the outer shell of the printer 1. A mechanism unit (not illustrated) of the printer 1 is accommodated in the case 14. The mechanism unit is a mechanism part that executes a printing operation in the printer 1.

The ink tank unit 20 is provided with an ink tank unit cover 21 and an ink tank unit bottom part 22, and is installed outside the case 14. The ink tank unit 20 can accommodate a plurality of ink tanks 30. The ink tank 30 stores the ink 34 for printing, and the ink 34 is supplied from the ink tank 30 to the print head 17 at the time of printing using the printer 1 (see FIG. 3).

The ink tank 30 is at least partially formed of a transmissive material, and the stored ink 34 is visible from outside. The ink tank unit cover 21 is provided with a transmissive window part 24 at a position facing the transmissive portion of the ink tank 30 to be accommodated. Therefore, a user can visually recognize the amount of the ink 34 in the ink tank 30 from outside the printer 1 via the window part 24.

The operation unit 13 and the paper discharge unit 11 are arranged on the front side of the printer 1. The operation unit 13 is provided with a power supply button, a setting button, a display panel and the like. The printer 1 is provided with a control unit 16 implemented on a control board 15 (see FIG. 3). The control unit 16 operates the above-described mechanism unit based on an instruction input from the operation unit 13 or the like, and performs conveyance of the sheet 12, driving of the print head 17 and the like to perform printing on the sheet 12. The printed sheet 12 is discharged from the paper discharge unit 11. The control board 15 is accommodated in the case 14.

Configuration of Ink Tank Unit

Figure 2:
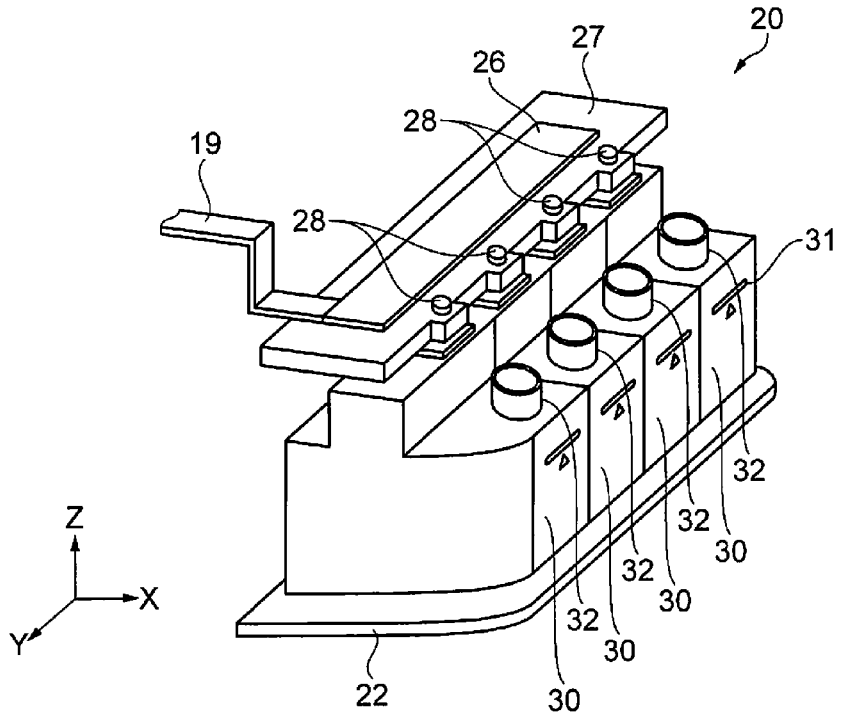
FIG. 2 is a perspective view showing an ink tank unit part in a state where an ink tank unit cover has been removed.

Next, the configuration of the ink tank unit 20 will be described with reference to FIG. 2. FIG. 2 is a perspective view showing the ink tank unit 20 in the state where the ink tank unit cover 21 has been removed.

As shown in FIG. 2, the ink tank unit 20 is provided with the ink tank unit bottom part 22. The ink tank unit 20 is also provided with a board receiver 27, which will be described later, in the vertically upward direction (Z axis direction) thereof so as to sandwich a space in which the ink tank 30 is mounted. The ink tank unit 20 is further provided with the ink tank unit cover 21 that surrounds the mounted ink tank 30. The ink tank unit bottom part 22 and the board receiver 27 are installed so as to be fixed to the printer 1.

The ink tank unit 20 can be mounted such that the plurality of ink tanks 30 are aligned to face the ink tank unit bottom part 22. In this embodiment, four ink tanks 30 are mounted. Different types (color, material and the like) of the ink 34 may be stored in the four ink tanks 30. One of the four ink tanks 30 has a larger size compared with the others, and can store more of the ink 34. In view of this, for example, the ink tank 30 with a larger size stores the black ink 34 that is used frequently, and the other ink tanks 30 can individually store yellow, magenta, and cyan ink 34 and the like.

The board receiver 27 vertically above the ink tank unit bottom part 22 is arranged so as to be in contact with the ink tanks 30 when the ink tanks 30 are mounted so as to be aligned in the ink tank unit 20. Therefore, the ink tanks 30 are mounted in the ink tank unit 20 so as to be sandwiched between the ink tank unit bottom part 22 and the board receiver 27.

Moreover, the ink tanks 30 are fixed to the board receiver 27 with screws 28. The board receiver 27 is provided with a circuit board 26 on which circuits including an alternating current generation circuit 40 (see FIG. 4), which will be described later, are implemented. Therefore, when the ink tanks 30 are fixed to the board receiver 27, the ink tanks 30 are also fixed to the circuit board 26. A signal wiring FFC (Flexible Flat Cable) 19 is connected to the circuit board 26, and the circuits implemented on the circuit board 26 and circuits implemented on the control board 15 of the printer 1 are electrically connected (see FIG. 3). Note that the ink tanks 30 are in contact with the board receiver 27 and the circuit board 26 in areas that are separated from ink injection ports 32 (described later in detail) provided on the ink tanks 30.

Configuration of Ink Tank

Figure 3:
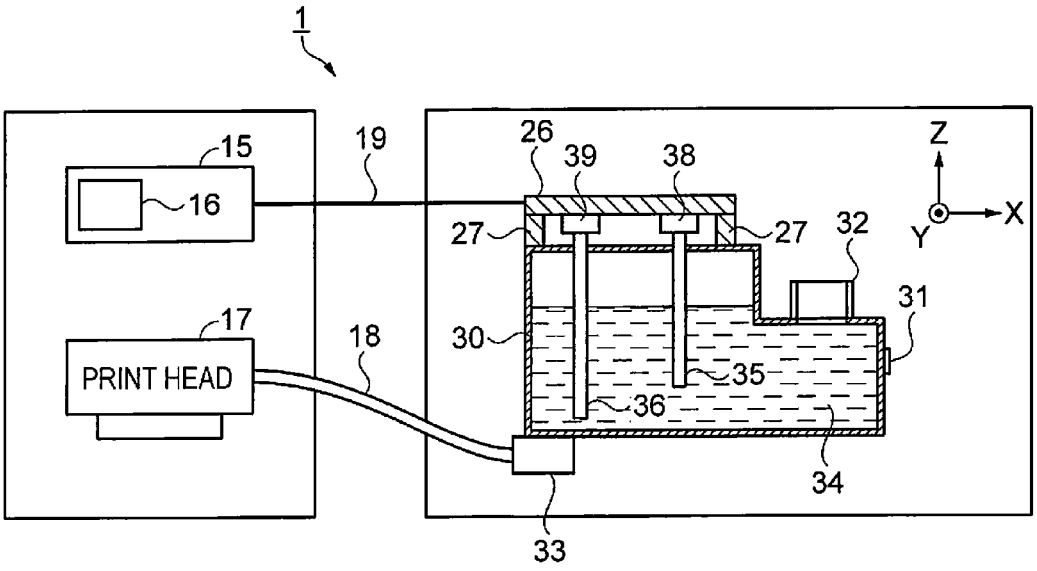
FIG. 3 is a schematic diagram showing a configuration of an ink tank and the relation between the ink tank and other constituent elements of an inkjet printer.

Next, the configuration of the ink tank 30 and the relation between the ink tank 30 and the printer 1 will be described with reference to FIGS. 2 and 3. FIG. 3 is a schematic diagram showing the configuration of the ink tank 30, and the relation between the ink tank 30 and the other constituent elements of the printer 1.

As shown in FIG. 3, the ink tank 30 is a container having a hollow portion therein, and the hollow portion can store the ink 34. Moreover, the ink tank 30 is provided with the ink injection port 32 that enables injection of the ink 34 on the vertically upward direction side (Z axis direction) (See FIGS. 2 and 3). Therefore, when the storage amount of the ink 34 becomes low, refilling of the ink tank 30 with the ink 34 from the ink injection port 32 is possible. Usually, a cap member (not illustrated) is mounted on the opening of the ink injection port 32 in an airtight manner. The user of the printer 1 can replenish the ink 34 in the ink tank 30 via the ink injection port 32 by removing the cap member.

Each of the ink tanks 30 is formed of an outer wall that is at least partially transmissive. In this embodiment, the outer wall in the X axis direction is partially transmissive. This outer wall surface has a mark 31 (see FIG. 2) that serves as an indication of the amount of ink, and the user can grasp the amount of ink using this mark 31.

The ink tank 30 is further provided with an ink supply unit 33 for sending out the stored ink 34 to the print head 17.

The ink tank 30 is yet further provided with a first electrode 35 as the first conductive member and a second electrode 36 as the second conductive member. The first electrode 35 and the second electrode 36 extend outward of the ink tank 30. The first electrode 35 and the second electrode 36 extending outward of the ink tank 30 are arranged to be in contact with the circuit board 26 arranged on the board receiver 27 when the ink tank 30 is mounted in the ink tank unit 20 so as to be sandwiched between the ink tank unit bottom part 22 and the board receiver 27.

The first electrode 35 and the second electrode 36 are manufactured with a stainless steel material having a plate bar shape that extends from outside the ink tank 30 to the hollow portion. The length of the first electrode 35 is shorter than the length of the second electrode 36. The second electrode 36 extends beyond the end of the first electrode 35 to a position near the bottom of the hollow portion. Accordingly, in the case where the ink 34 is poured at least to such an extent that the hollow portion is filled, both the first electrode 35 and the second electrode 36 are immersed in the ink 34. Subsequently, printing is performed, and when the ink 34 is consumed and the amount of the ink decreases, the first electrode 35 is exposed out of the ink 34 and only the second electrode 36 is immersed in the ink 34.

As described above, the ink tank 30 is mounted in the ink tank unit 20 so as to be sandwiched between the ink tank unit bottom part 22 and the board receiver 27. Moreover, the circuit board 26 is arranged on the board receiver 27 to be positioned such that the circuit board 26 can face and be in contact with the first electrode 35 and the second electrode 36 of the ink tank 30. A first terminal 38 and a second terminal 39 are formed on the circuit board 26 at positions facing the first electrode 35 and the second electrode 36. Accordingly, when the ink tank 30 is mounted in the ink tank unit 20, the first electrode 35 and the first terminal 38 are brought into contact and are electrically connected, and the second electrode 36 and the second terminal 39 are brought into contact and are electrically connected.

Moreover, the board receiver 27 and the ink tank 30 are fixed to each other with the screw 28, so that the first electrode 35 is crimped to the first terminal 38, and the second electrode 36 is crimped to the second terminal 39. Therefore, reliable electrical connections between the electrodes 35 and 36 and the terminals 38 and 39 are respectively formed.

Furthermore, the circuits implemented on the circuit board 26 and the circuits implemented on the control board 15 of the printer 1 are connected to each other via the signal wiring FFC 19. The circuits implemented on the control board 15 include the control unit 16, and thus the circuits on the circuit board 26 can perform mutual communication with the control unit 16.

Moreover, the ink 34 has conductivity with an ink resistance value Ri (see FIG. 5) based on the material and the composition thereof. Therefore, in the case where both the first electrode 35 and the second electrode 36 are immersed in the ink 34, the first electrode 35 and the second electrode 36 are in the state of being electrically connected via the ink 34.

The ink supply unit 33 is provided at a site corresponding to a lower portion of the ink tank 30 in a mounted state in which the ink tank 30 is used. The ink 34 injected from the ink injection port 32 into the ink tank 30 is stored in the hollow portion, and is sent out from the ink supply unit 33 to the outside. Meanwhile, the printer 1 has a tube 18 as the ink transportation path arranged to be fixed thereto. One end of the tube 18 is coupled to the ink supply unit 33, and the other end of the tube 18 is coupled to the print head 17. Accordingly, the ink 34 in the ink tank 30 is transported to the print head 17 via the tube 18 and is used for printing.

The ink tank unit 20 is configured such that the ink supply unit 33 is joined to the tube 18 when the ink tank 30 is mounted.

As described above, when the ink tank 30 is mounted to the ink tank unit 20 at the time of manufacturing the printer 1, the ink supply unit 33 is joined to the tube 18, and the first electrode 35 and the second electrode 36 are electrically connected to the first terminal 38 and the second terminal 39 on the circuit board 26 respectively. Accordingly, the ink 34 stored in the ink tank 30 is brought into a state in which the ink 34 is ready to be used in the printer.

Configuration and Operations of Liquid Detecting Unit

Figure 4:
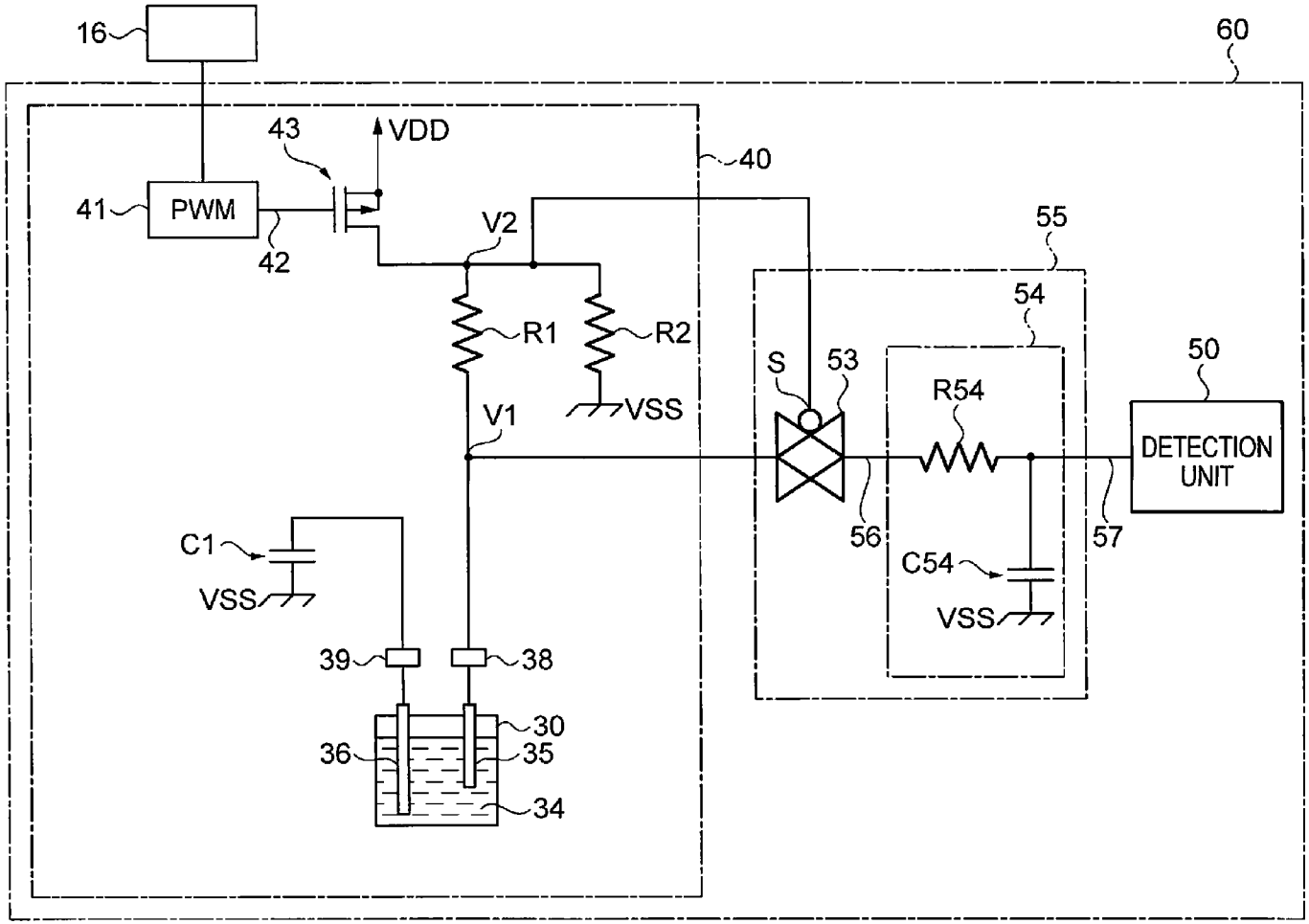
FIG. 4 is a diagram showing an example of a liquid detecting unit.
Figure 5:
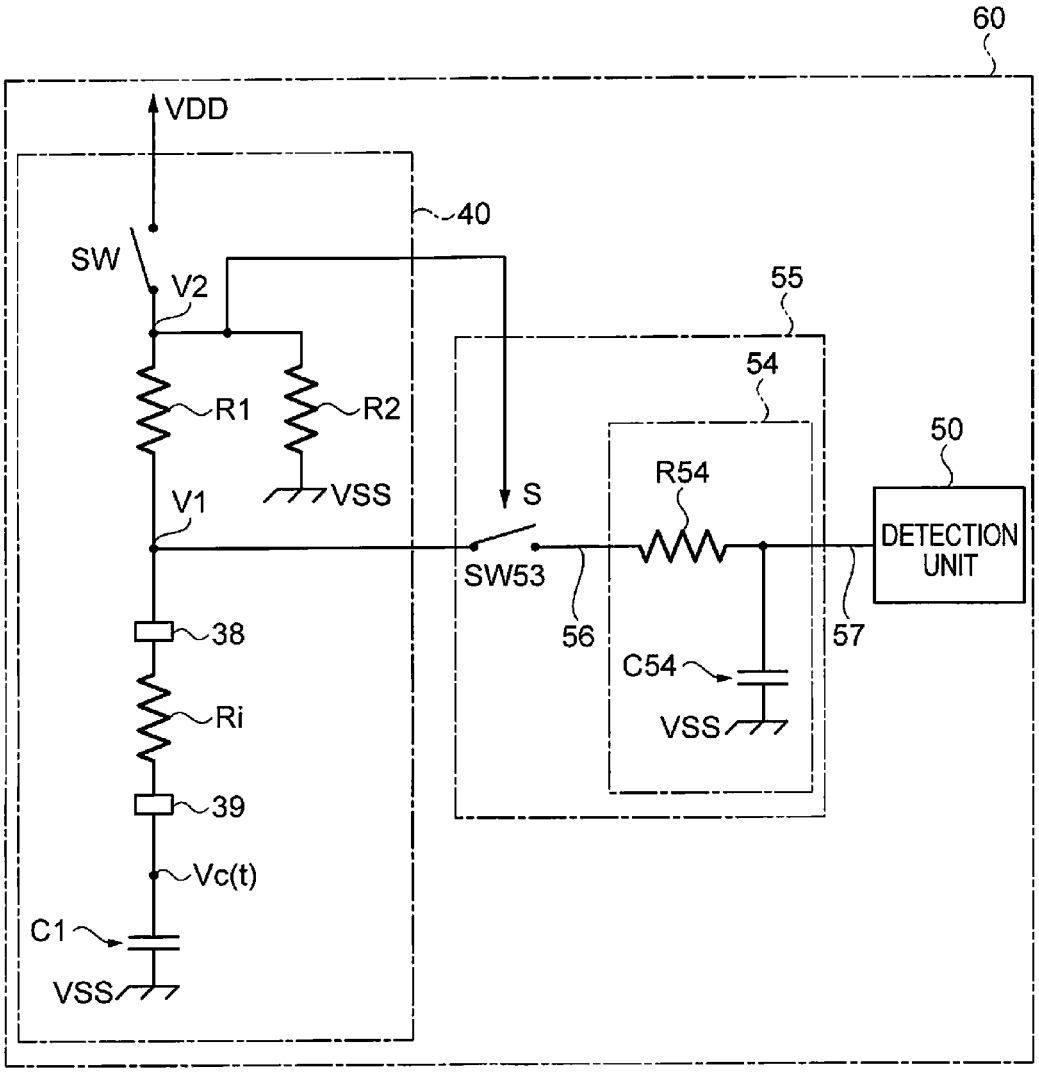
FIG. 5 is an equivalent circuit diagram of the liquid detecting unit in FIG. 4.

Next, a liquid detecting unit 60 will be described with reference to FIGS. 4 to 6A-6G. FIG. 4 is a diagram showing an example of the liquid detecting unit 60. FIG. 5 is an equivalent circuit diagram of the liquid detecting unit 60 in FIG. 4. FIGS. 6A-6G are timing charts showing an example of the operations of the liquid detecting unit 60.

Note that in FIG. 4, VDD indicates a potential on a higher potential side of a power supply for operating the liquid detecting unit 60. Moreover, VSS indicate a potential on a lower potential side of the power supply, and is a reference potential (ground). Similar reference signs will be used in the following figures.

As shown in FIG. 4, the liquid detecting unit 60 is constituted including the alternating current generation circuit 40, a detection output generation unit 55 and a detection unit 50.

The alternating current generation circuit 40 is constituted by the following constituent elements:

a) the first electrode 35 as the first conductive member and the second electrode 36 as the second conductive member;

b) the periodic signal generation unit 41 for generating a predetermined periodic signal;

c) a p-channel FET 43 as the predetermined potential supply unit;

d) a first resistance R1 whose one end is connected to the first electrode 35;

e) the first terminal 38 connecting the first electrode 35 and the first resistance R1;

f) a second resistance R2 constituting the reference potential supply unit;

g) a capacitance C1 connected between the second electrode 36 and a reference potential; and h) the second terminal 39 connecting the second electrode 36 and the capacitance C1.

Moreover, the detection output generation unit 55 is constituted by the following constituent elements:

i) an analog switch 53 provided with a control terminal S; and j) a resistance R54 and a capacitance C54 constituting an integration circuit 54.

In the liquid detecting unit 60, the alternating current generation circuit 40 generates a detection voltage V1, the detection output generation unit 55 performs waveform shaping on the detection voltage V1, and the detection unit 50 detects the detection voltage V1. Here, the detection voltage V1 is the potential of the connection point of the first electrode 35 and the first resistance R1, which is a first connection point. Accordingly, information such as the amount or the type of the ink 34 is detected.

The above-described constituent elements of the alternating current generation circuit 40 are connected as shown in FIG. 4 so as to form the alternating current generation circuit 40. In particular, a source terminal of the p-channel FET 43 is connected to VDD. A gate terminal of the p-channel FET 43 is connected to a PWM output 42 that is an output of a periodic signal generation unit (also referred to as PWM) 41. The first resistance R1 and the second resistance R2 are connected to a drain terminal of the p-channel FET 43. Here, a connection point of the drain terminal, the first resistance R1 and the second resistance R2 is referred to as second connection point, and assume that the potential of the second connection point is V2. One end of the first resistance R1 is connected to the first electrode 35 via the first terminal 38, and the other end is connected to the drain terminal. One end of the second resistance R2 is connected to VSS, and the other end is connected to the drain terminal. The capacitance C1 is connected to the second electrode 36. One end of the capacitance C1 is connected to VSS, and the other end is connected to the second electrode 36 via the second terminal 39.

Note that the periodic signal generation unit 41 is constituted by a signal generator that can generate periodic signals at various timings based on control by the control unit 16 of the printer 1.

Here, the alternating current generation circuit 40 can be configured such that the first resistance R1=10 kΩ, the second resistance R2=1 kΩ, and the first capacitance C1=1 nF, for example.

The detection output generation unit 55 transmits the detection voltage V1 generated by the alternating current generation circuit 40 to the integration circuit 54 using the analog switch 53 at a specific timing, and the detection voltage V1 is smoothed by the integration circuit 54 (will be described later in detail). The output of the integration circuit 54 that has been smoothed becomes a detection output 57 to be detected by the detection unit 50. As shown in FIG. 4, the control terminal S of the analog switch 53 is connected to the second connection point in the alternating current generation circuit 40, and the detection voltage V1 is transmitted to the integration circuit 54 based on the potential V2 of the second connection point. One of input/output terminals of the analog switch 53 is connected to the first connection point in the alternating current generation circuit 40. As described above, the first connection point is a connection point of the first electrode 35 and the first resistance R1, and the potential of the first connection point is the detection voltage V1. The other input/output terminal of the analog switch 53 is connected to one end of the resistance R54, which is an input of the integration circuit 54. The other end of the resistance R54 is connected to the other end of the capacitance C54 whose one end is connected to VSS, and the resistance R54 and the capacitance C54 constitute the integration circuit 54. The potential of the connection point of the resistance R54 and the capacitance C54 is the output of the integration circuit 54, and will be the detection output 57 which is the output of the detection output generation unit 55.

Note that the detection output generation unit 55 can be configured such that the resistance R54=66 MI, and the capacitance C54=0.01 μF, for example.

Figures 6A, 6B, 6C, 6D, 6E, 6F, 6G:
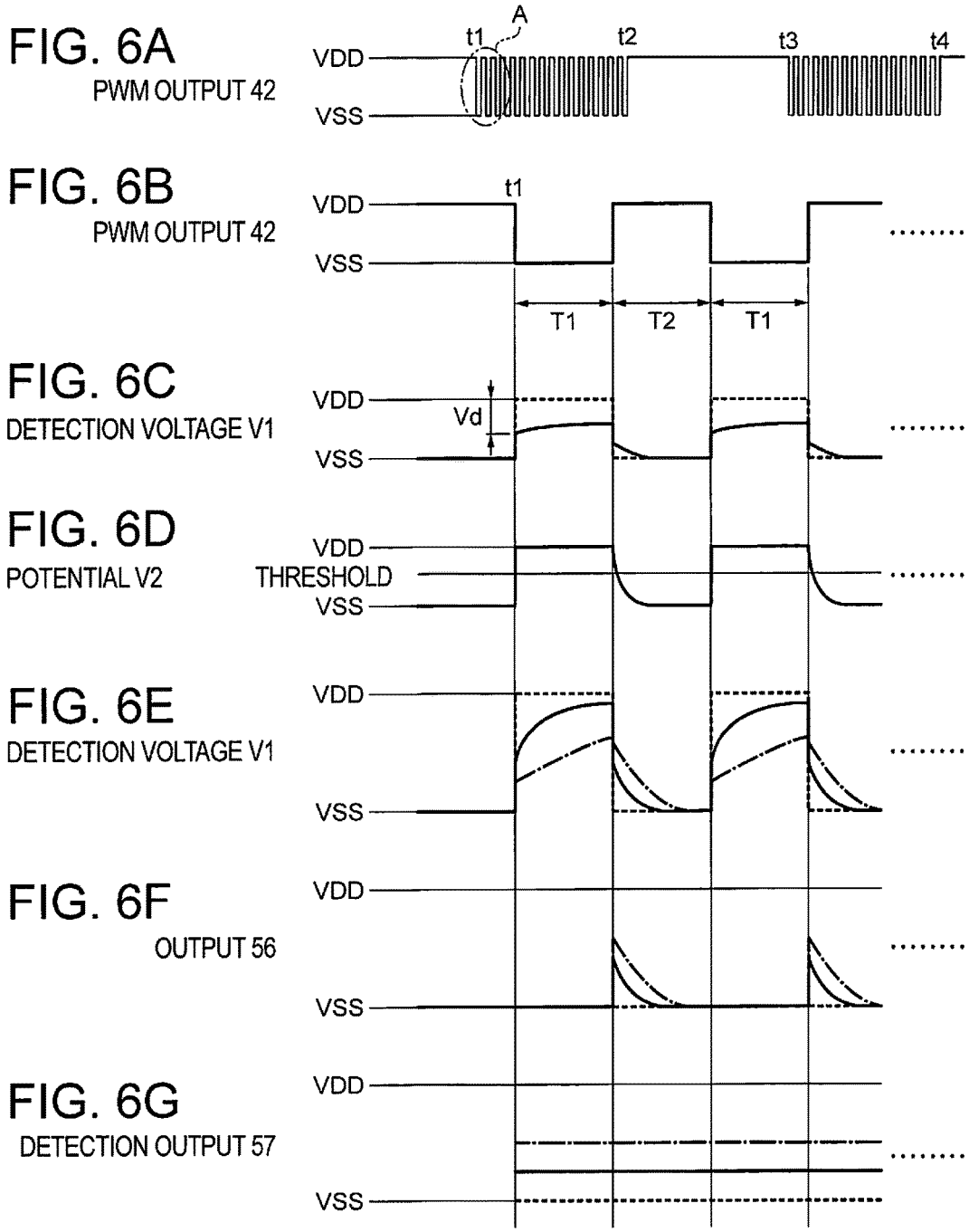
FIGS. 6A-6G are timing charts showing an example of operations of a liquid detecting unit.

FIGS. 6A-6G are timing charts showing an example of the operations of the liquid detecting unit 60, and also show the potential of the detection voltage V1 and the potential of the detection output 57 that are based on the timing chart. The PWM output 42 in FIG. 6A and the PWM output 42 of FIG. 6B both show the output 42 of periodic signal generation unit 41. The PWM output 42 in FIG. 6B represents a diagram of a portion of the PWM output 42 of FIG. 6A, which is enlarged in time scale. In particular, FIG. 6B is an enlarged diagram of an area A circled by a dashed double-dotted line shown in the PWM output 42 in FIG. 6A. In FIG. 6C, the detection voltage V1 that changes in accordance with the operations of the alternating current generation circuit 40, which will be described below, is indicated by a solid line, and the detection voltage V1 in the case where the ink 34 does not exist is indicated by a broken line. FIG. 6D shows the potential V2 of the second connection point for controlling the operations of the analog switch 53. In FIG. 6E, the detection voltages V1 for the ink 34 of different types are indicated by a solid line and a dashed-dotted line, and the detection voltage V1 in the case where the ink 34 does not exist is indicated by a broken line. FIG. 6F shows the output 56 of the analog switch 53. FIG. 6G shows the detection output 57.

In the periodic signal generation unit 41, starting and stopping of periodic signal oscillation is controlled in accordance with a control signal from the control unit 16. The periodic signal generation unit 41 outputs a signal for periodically repeating a first time period T1 (VSS level) and a second time period T2 (VDD level) as the PWM output 42 in the time period when receiving an oscillation instruction from the control unit 16. In FIG. 6A, the time periods from t1 to t2 and from t3 to t4 are the time periods when the oscillation instruction is being received from the control unit 16. These time periods are called periodic signal segments. The length of one segment is set to a time that allows acquiring enough detection output 57 for the detection unit to be able to determine the ink information for one ink tank (t1 to t4 represent times). For example, the PWM output 42 periodically repeats the first time period T1 and the second time period T2 with the same duty ratio (50%) within a periodic signal segment.

Upon receiving, from the control unit 16, a signal for stopping oscillation, the periodic signal generation unit 41 stops oscillation and outputs a signal of Vdd level as the output 42 (time period from t2 to t3).

In the alternating current generation circuit 40 shown in FIG. 4, ON/OFF of the p-channel FET 43 is controlled based on the PWM output 42. In particular, the p-channel FET 43 is turned on when the PWM output 42 is in the first time period T1 (gate terminal is at VSS level), and turned off when the PWM output 42 is in the second time period T2 (gate terminal is at VDD level). As a result, the drain terminal is at VDD level in the first time period T1, and the drain terminal is in a high impedance state in the second time period T2. Therefore, in the first time period T1, the first electrode 35 is connected to VDD via the first resistance R1, and in the second time period T2, the first electrode 35 is brought into the state in which the connection is shut off. In this manner, the p-channel FET 43 functions as the predetermined potential supply unit.

Because the second resistance R2 is also connected to VDD in the first time period T1, a current flows from VDD to VSS via the second resistance R2. Because this current will increase current consumption of the alternating current generation circuit 40, it is suitable to increase the value of the second resistance R2 as much as possible in order to prevent the increase in current consumption.

As described above, in the state where both the first electrode 35 and the second electrode 36 are immersed in the ink 34, both electrodes are in a conductive state via the ink resistance value Ri of the ink 34 (see FIG. 5).

Therefore, in the first time period T1, a current flows on a path in the order of VDD, the p-channel FET 43, the first resistance R1, the first terminal 38, the first electrode 35, the ink 34, the second electrode 36, the second terminal 39, the capacitance C1, and VSS. When a current flows on this path, the capacitance C1 is charged. Therefore, the potential of the capacitance C1 gradually approaches VDD, and as shown in FIG. 6C, in the first time period T1, the detection voltage V1 gradually approaches VDD.

Next, in the second time period T2, the p-channel FET 43 is turned off. Therefore, a current does not flow any longer from VDD, and the potential of the charged capacitance C1 is the highest in the circuit system. As a result, a current flows on a path in the order of the capacitance C1, the second terminal 39, the second electrode 36, the ink 34, the first electrode 35, the first terminal 38, the first resistance R1, the second resistance R2 and VSS, and a charge charged in the capacitance C1 in the first time period T1 is discharged. Therefore, the second resistance R2 functions as the reference potential supply unit for connecting the first electrode 35 to VSS via the first resistance R1. At this time, the potential of the capacitance C1 gradually decreases in accordance with the discharge. Therefore, as shown in FIG. 6C, in the second time period T2, the detection voltage V1 gradually approaches VSS.

As is evident from the above description, the current flowing through the ink 34 in the first time period T1 and the current flowing through the ink 34 in the second time period T2 are reversed in flowing direction. That is, in the periodic signal segment in which the PWM output 42 periodically repeats the first time period T1 and the second time period T2, an alternating current flows through the ink 34.

Next, the operations of the detection output generation unit 55 shown in FIG. 4 will be described. The potential V2 for controlling the analog switch 53 changes, as shown in FIG. 6D, based on the PWM output 42 shown in FIG. 6B. In particular, when the PWM output 42 is at VDD level, the p-channel FET 43 is turned off, and thus the potential V2 approaches VSS via the second resistance R2. On the other hand, when the PWM output 42 is at VSS level, the p-channel FET 43 is turned on, and thus the potential V2 becomes VDD. The analog switch 53 is configured to be turned off when the potential V2 exceeds a predetermined threshold and approaches VDD, and be turned on when the potential V2 falls below the predetermined threshold and approaches VSS.

Therefore, in the second time period T2 when the potential V2 approaches VSS, the detection voltage V1 is transmitted to the output 56 of the analog switch 53. On the other hand, in the first time period T1 when the potential V2 becomes VDD, transmission of the detection voltage V1 is shut off, and thus the output 56 enters an unstable state. FIG. 6F shows that state, and in particular, shows that the detection voltage V1 (FIG. 6E) appears in the output 56 in the second time period T2.

Here, in FIG. 6E, the solid line indicates the detection voltage V1 of pigment-based ink whose ink resistance value Ri is large (see FIG. 5), and the dashed-dotted line indicates the detection voltage V1 of dye-based ink whose ink resistance value Ri is smaller than that of the pigment-based ink. In this manner, the detection voltage V1 takes different values in accordance with the type of the ink 34, and a detailed description of this will be given later.

As described above, the detection voltage V1 is extracted based on change in the potential V2 and becomes the output 56 of the analog switch 53 (FIG. 6F). Next, the output 56 is transmitted to the integration circuit 54 and is smoothed, and the detection output 57 is generated. As a result, as shown in FIG. 6G, the detection output 57 which has a different potential level in accordance with the type of the ink 34 and is stable is generated. In particular, in both cases, that is, the case where the dye-based ink exists and the case where the pigment-based ink exists, the dye-based ink indicated by the dashed-dotted line results in the detection output 57 having the largest potential, and the value of the potential of the detection output 57 of the pigment-based ink indicated by the solid line is smaller than that of the potential of the detection output 57 of the dye-based ink.

Therefore, it can be seen that the ink 34 exists between the first electrode 35 and the second electrode 36 by the detection output 57 being detected by the later-stage detection unit 50. Furthermore, the detection output 57 has a potential level that varies in accordance with the type of the ink 34, and thus the type of the ink 34 can be also detected by providing an A/D converter in the detection unit 50 and grasping a difference in potential level, for example.

However, when the ink 34 is consumed and the ink 34 does not exist between the second electrode 36 and the first electrode 35 any longer, the first electrode 35 and the second electrode 36 are not in conduction and enter an insulated state. Therefore, when the p-channel FET 43 is turned on in the first time period T1, the detection voltage V1 is connected to VDD via the first resistance R1. Moreover, when the p-channel FET 43 is turned off in the second time period T2, the detection voltage V1 is connected to VSS via the first resistance R1 and the second resistance R2. As a result, as indicated by the broken lines in FIGS. 6C and 6E, the detection voltage V1 becomes VDD in the first time period T1 and VSS in the second time period T2. Therefore, as shown in FIG. 6G, the detection output 57 is at VSS level, and it is detected that the ink 34 does not exist between the first electrode 35 and the second electrode 36.

Next, the behavior of the alternating current generation circuit 40 will be described in more detail with reference to FIGS. 5 and 6A-6G. In FIG. 5, SW indicates a switch representing the p-channel FET 43. R1 indicates the first resistance R1, and R2 indicates the second resistance R2. Ri indicates the ink resistance value Ri of the ink 34, and C1 indicates the capacitance C1. SW53 indicates a switch representing the analog switch 53.

In the case where both the first electrode 35 and the second electrode 36 are immersed in the ink 34, when SW is turned on, C1 is connected to VDD via R1 and Ri, and a current flows. The detection voltage V1 in this case can be represented by an expression 1.

$$V1=VDD-(R1/(R1+Ri))\times(VDD-Vc(t)) \quad \text{Expression 1}$$

Here, Vc(t) is the potential of C1. (t) is a parameter, and indicates that Vc(t) changes over time t.

In the first time period T1, C1 is charged by VDD, and Vc(t) gradually increases over time. As a result, the third term on the right side in the expression 1, that is, (VDD-Vc(t)) gradually decreases, and thus the value deducted from the first term on the right side, VDD, decreases. Therefore, as shown by the detection voltage V1 in FIG. 6C, the detection voltage V1 gradually approaches VDD. Therefore, a potential difference Vd between VDD and the detection voltage V1 gradually decreases.

Here, if C1 has been sufficiently discharged and Vc (t1) is 0 at a time t1 when the first time period T1 is started, then $$V1=(Ri/(R1+Ri))\times VDD \quad \text{Expression 2}$$

is obtained by substituting the value in the expression 1. That is, the detection voltage V1 starts with the value represented by the expression 2 as an initial value, gradually increases and approaches VDD, whereas the potential difference Vd gradually decreases.

Moreover, as seen from the expression 2, the larger Ri is, the larger the initial value of the detection voltage V1 is. Therefore, as shown in FIG. 6E, at the time t1, the detection voltage V1 of the pigment-based ink having a large Ri indicated by the solid line appears as a value larger than that of the detection voltage V1 of the dye-based ink having a small Ri indicated by the dashed-dotted line.

In the second time period T2, the charge is discharged from the C1 that was charged in the first time period T1 to VSS via Ri, R1 and R2. Therefore, Vc(t) gradually decreases, and as shown in FIGS. 6C to 6E, the detection voltage V1 gradually decreases to become VSS. Here, if Ri is large, the charging current for charging C1 in the first time period T1 is small, and thus the charging does not proceed and Vc(t) does not increase. That is, the dye-based ink whose Ri is smaller than that of the pigment-based ink allows more charging of C1 and allows Vc(t) to increase. Therefore, as shown in FIG. 6E, when discharge of C1 is started in the second time period T2, the detection voltage V1 of the dye-based ink whose Ri is small, which is indicated by the dashed-dotted line, appears as a larger value than the detection voltage V1 of the pigment-based ink whose Ri is large, which is indicated by the solid line.

As described above, the liquid detecting unit 60 can generate the detection output 57 that varies in accordance with the type of the ink 34, and detect the ink information such as presence or absence and the type of the ink 34.

Moreover, as seen from FIG. 3, when the ink 34 is consumed and the ink amount decreases, the tip of the first electrode 35 that is shorter than the second electrode 36 first becomes separated from the interface with the ink 34. The amount of the ink 34 at this time is uniquely determined based on the size of the hollow portion of the ink tank 30 and the length of the first electrode 35. Therefore, when it is detected that the ink 34 does not exist between the first electrode 35 and the second electrode 36, the amount of the remaining ink 34 can be seen as the ink information.

Moreover, when the first time period T1 is prolonged, the value of the first resistance R1 decreases, or the value of the capacitance C1 decreases, the potential of the capacitance C1 approaches VDD further in the first time period T1. As a result, a current does not flow any longer from VDD to the capacitance C1. The state in which a current does not flow is the same as the case where the ink 34 does not exist, and thus detection of presence or absence of the ink 34 is difficult. Therefore, it is preferable that the length of the first time period T1 (in other words, the period of the first time period T1 and the second time period T2 of the PWM output 42), the value of the first resistance R1 and the value of the capacitance C1 are determined such that in the case where both the first electrode 35 and the second electrode 36 are immersed in the ink 34, a current always flows from VDD to the capacitance C1 and the potential difference Vd exists in the first time period T1.

Actions and Effects

As described above, actions and effects such as the following are obtained according to the first embodiment.

First, the alternating current generation circuit 40 of the liquid detecting unit 60 can cause an alternating current to flow through the ink 34. Therefore, it is possible to realize the liquid detecting unit 60 that does not allow generation of air bubbles or deposit of the components of the ink 34 on the first electrode 35 or the second electrode 36 due to electrolysis, when performing detection of the ink information.

Furthermore, it is possible to realize the alternating current generation circuit 40 for generating the detection voltage V1 that always has the potential difference Vd with respect to VDD in the first time period T1 in the case where the ink 34 exists, and generating the detection voltage V1 that has a potential difference Vd of 0 in the first time period T1 in the case where the ink 34 does not exist. It is also possible to realize the detection output generation unit 55 for generating the detection output 57 for detecting presence or absence and the type of the ink 34 based on the detection voltage V1. Therefore, by being provided with the liquid detecting unit 60 constituted including the alternating current generation circuit 40, the detection output generation unit 55 and the detection unit 50 for detecting the detection output 57, the printer 1 can detect the ink information without generation of air bubbles or deposit of the components of the liquid on the electrodes due to electrolysis.

Furthermore, the alternating current generation circuit 40 of the liquid detecting unit 60 can be constituted including the predetermined potential supply unit and the reference potential supply unit. Also, the predetermined potential supply unit can be constituted by the one p-channel FET 43, and the reference potential supply unit can be constituted by the one resistance R2. Therefore, the liquid detecting unit 60 can be constituted by a small number of electric elements. As a result, the costs and the sizes of the liquid detecting unit 60 and the printer 1 provided with the same can be reduced.

Furthermore, the alternating current generation circuit 40 of the liquid detecting unit 60 can be configured such that the p-channel FET 43 as the predetermined potential supply unit and the second resistance R2 as the reference potential supply unit are connected using a single wire, as shown in FIG. 4. Therefore, distributed-arrangement of the predetermined potential supply unit and the reference potential supply unit on different circuit boards is easy. For example, it is also possible to arrange the control unit 16, the periodic signal generation unit (PWM) 41 and the p-channel FET 43 on the control board 15 of the printer 1, arrange the first resistance R1, the second resistance R2, the first terminal 38, the second terminal 39 and the capacitance C1 on the circuit board 26 on the ink tank unit 20 side, and connect the p-channel FET 43 and the second resistance R2 using the signal wiring FFC 19. Therefore, distributed-arrangement of the constituent elements of the alternating current generation circuit 40 on different circuit boards using minimum wiring is possible, and thus the degree of freedom in board layout designing can be improved while suppressing an increase in cost.

Furthermore, by suitably determining the period of the periodic signal of the PWM output 42, the value of the first resistance R1 and the value of the capacitance C1, the alternating current generation circuit 40 of the liquid detecting unit 60 can be set such that a current always flows from VDD to the capacitance C1 via the first resistance R1 and the ink 34 in the first time period T1 in the case where both the first electrode 35 and the second electrode 36 are immersed in the ink 34. As a result, the detection voltage V1 can always have the potential difference Vd with respect to VDD. Therefore, the ink information such as presence or absence, the amount and the type of the ink 34 can be detected by the detection unit 50 detecting the detection output 57 generated by the detection output generation unit 55 based on the detection voltage V1.

Furthermore, a periodic signal segment, in which the first time period T1 and the second time period T2 are periodically repeated as the PWM output 42, is provided such that a signal that has a potential level equivalent to that in the second time period T2 can be used in a time period when a periodic signal does not exist. Therefore, in the time period when a periodic signal does not exist, the capacitance C1 that is charged/discharged in a time period when a periodic signal exists can be sufficiently discharged. As a result, the potential of the capacitance C1 at a time when a next periodic signal starts can be maintained at a certain value, and therefore the alternating current generation circuit 40 for generating the detection voltage V1 that is stable can be realized, and consequently the liquid detecting unit 60 for performing stable operations can be realized.

Moreover, the detection output generation unit 55 of the liquid detecting unit 60 can be constituted by the analog switch 53 and the integration circuit 54. Therefore, the detection voltage V1 generated in the first time period T1 and the second time period T2 can be selected by performing time division using the analog switch 53. Furthermore, the detection output 57 having a stable potential level is generated by processing the selected detection voltage V1 using the integration circuit 54. As a result, detection of the detection output 57 can be performed at an arbitrary timing, and thus the degree of freedom in product designing can be improved.

Furthermore, the detection output generation unit 55 can be constituted by the analog switch 53 and the integration circuit 54 that is constituted by passive elements. Therefore, compared with the case where the detection output generation unit 55 is constituted by a standalone MOSFET or a bipolar transistor, it is possible to generate the detection output 57 that is stable without being influenced by variation in threshold of the MOSFET (Vth) or variation in the DC current gain (hfe) of the bipolar transistor.

Moreover, by configuring the detection output generation unit 55 to generate the detection output 57 in the second time period T2, the detection output 57 corresponding to the type of the ink 34 can be generated in the case where the ink 34 exists, and the detection output 57 can be allowed to become VSS in the case where the ink 34 does not exist. As a result, in the case where the detection output 57 is at VSS level even though the ink 34 exists, it can be determined that a malfunction has occurred in the liquid detecting unit 60.

Furthermore, the printer 1 is provided with the liquid detecting unit 60 of this embodiment. Because the ink tank 30 constituting the liquid detecting unit 60 is provided with the ink injection port 32, refilling of the ink 34 in the printer 1 is possible.

Although the foregoing has described the first embodiment of the invention, many modifications can be made thereon without departing from the essential spirit of the invention. For example, besides the first embodiment, the following modified examples can be conceived.

First Modified Example

Figure 7:
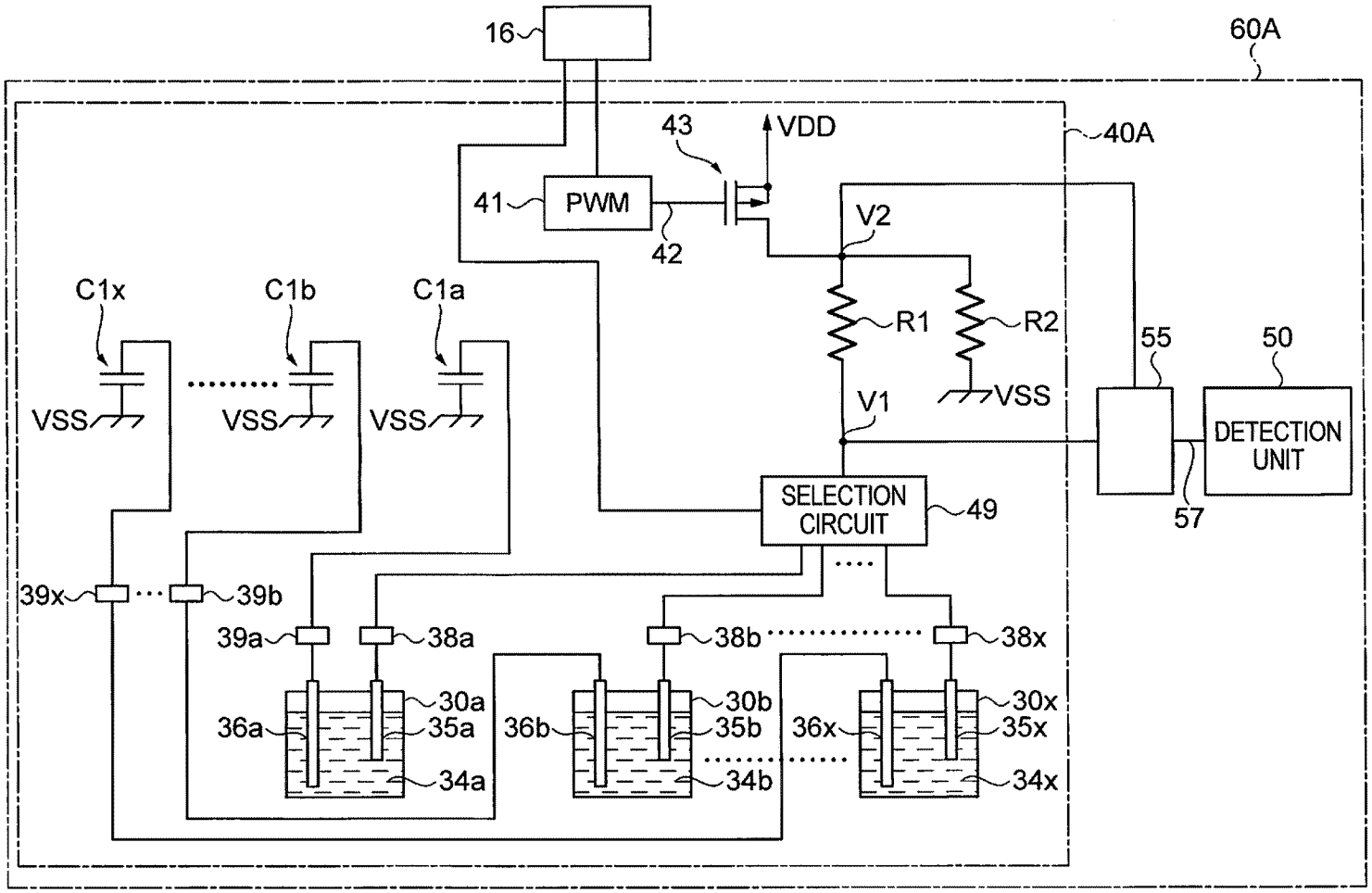
FIG. 7 is a diagram showing another example of a liquid detecting unit.

FIG. 7 is a diagram showing a modified example of the liquid detecting unit 60. In particular, FIG. 7 is a diagram showing a liquid detecting unit 60A constituted including an alternating current generation circuit 40A, which is a modified example of the alternating current generation circuit 40 (see FIG. 4). The alternating current generation circuit 40A is a circuit in which a selection circuit 49 is added between the first resistance R1 and the first terminal 38 in the alternating current generation circuit 40. The selection circuit 49 is a multiplexer circuit constituted by an analog switch or the like, for example. The first electrodes 35 (35*a*, 35*b*, . . . , 35*x*) of the plurality of ink tanks 30 (30*a*, 30*b*, . . . , 30*x*) mounted in the ink tank unit 20 are respectively connected to the selection circuit 49 via the first terminals 38 (38*a*, 38*b*, . . . , 38*x*). The selection circuit 49 selects one from among the plurality of first electrodes 35 (35*a*, 35*b*, . . . , 35*x*) connected thereto based on control by the control unit 16, or disconnects all of the plurality of first electrodes 35 and one end of R1. The selected first electrode 35 (for example, 35*a*) is connected to the first resistance R1 by the selection circuit 49. On the other hand, the second electrodes 36 (36*a*, 36*b*, . . . , 36*x*) of the ink tanks 30 (30*a*, 30*b*, . . . , 30*x*) are connected to the individual capacitances C1 (C1*a*, C1*b*, . . . , C1*x*) via the second terminals 39 (39*a*, 39*b*, . . . , 39*x*) respectively.

Therefore, in the case where the first electrode 35*a* is selected by the selection circuit 49, the detection voltage V1 that enables detection of the ink information regarding the ink tank 30*a* can be generated by the operations similar to the above-mentioned operations of the alternating current generation circuit 40. As a result, the liquid detecting unit 60 can detect the ink information regarding the ink tank 30*a*.

Similarly, if another first electrode 35 (35*b*, . . . , 35*x*) is selected by the selection circuit 49, the ink information regarding the ink 34 stored in the ink tank 30 (30*b*, . . . , 30*x*) corresponding to the selected first electrode 35 (35*b*, . . . , 35*x*) can be detected.

Actions and Effects

According to the first modified example, the ink information regarding the ink 34 of the plurality of ink tanks 30 mounted on the ink tank unit 20 can be detected using the one alternating current generation circuit 40A. Therefore, all the constituent elements of the alternating current generation circuit 40 (40A) do not need to be provided for each of the ink tanks 30, and the constituent elements of the alternating current generation circuit 40 (40A) can be shared. As a result, if the plurality of ink tanks 30 are provided, the cost and the size of the liquid detecting unit 60 (60A) can be reduced.

Furthermore, the capacitance C1 is individually connected to each of the second electrodes 36 of the plurality of ink tanks 30. Therefore, the capacitance C1 can be arranged near the ink tanks 30, and thus the wiring between the second electrode 36 and the capacitance C1 becomes easy, making it possible to stabilize the electrical property.

Second Modified Example

Figure 8:
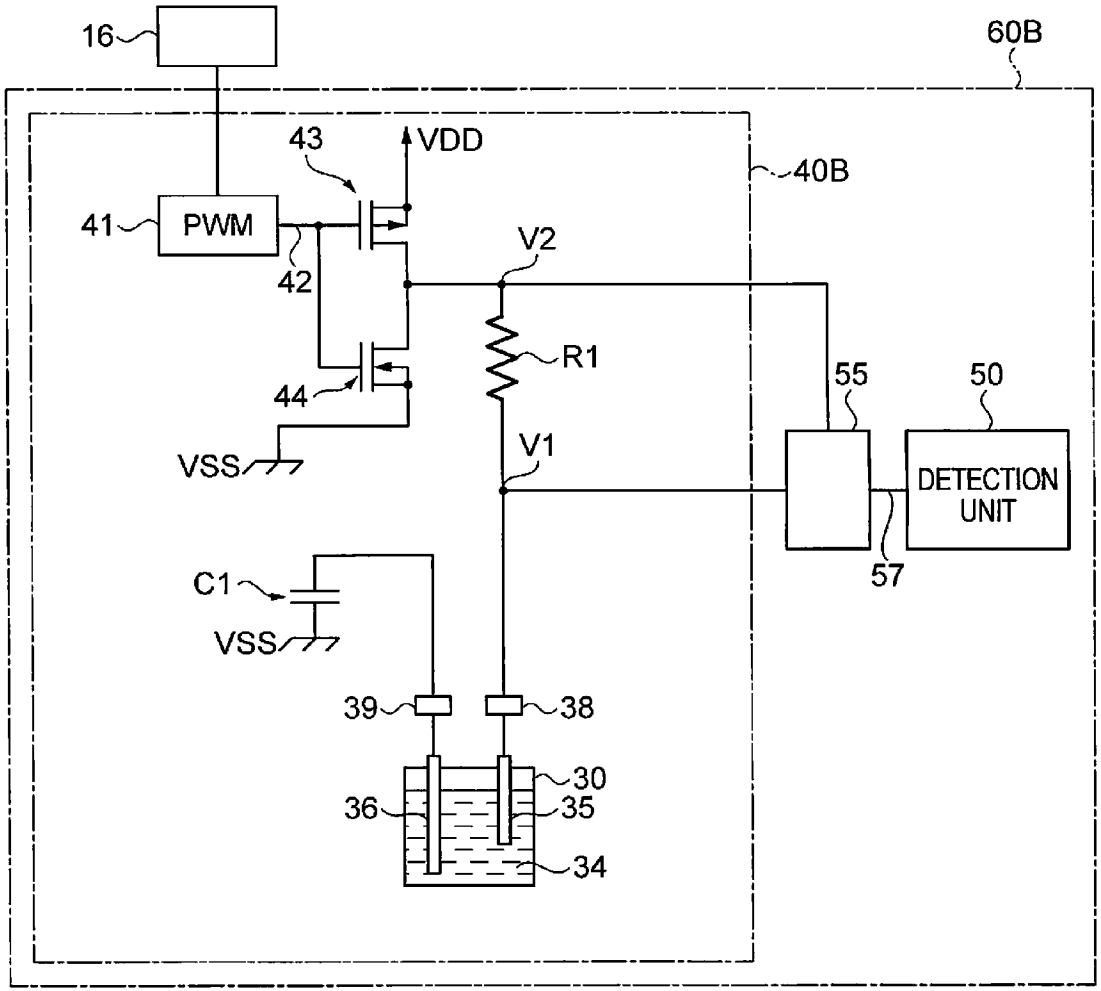
FIG. 8 is a diagram showing yet another example of a liquid detecting unit.

FIG. 8 is a diagram showing another modified example of the liquid detecting unit 60. In particular, FIG. 8 is a diagram showing a liquid detecting unit 60B constituted including an alternating current generation circuit 40B, which is another modified example of the alternating current generation circuit 40 (see FIG. 4). The alternating current generation circuit 40B is a circuit in which the second resistance R2 in the alternating current generation circuit 40 is replaced with an n-channel FET 44 that is complementarily connected to the p-channel FET 43. Accordingly, when the PWM output 42 is in the first time period T1, the p-channel FET 43 serving as the predetermined potential supply unit is turned on and the re-channel FET 44 is turned off. Therefore, a current flows to the capacitance C1 via the first resistance R1 and the ink 34. Moreover, when the PWM output 42 is in the second time period T2, the p-channel FET 43 is turned off and the n-channel FET 44 serving as the reference potential supply unit is turned on. Therefore, a current flows from the capacitance C1, which was charged in the first time period T1, via the ink 34 and the first resistance R1.

Therefore, similarly to the above-mentioned operations of the alternating current generation circuit 40, the detection voltage V1 that enables detection of the ink information regarding the ink 34 can be generated.

Actions and Effects

The predetermined potential supply unit can be constituted by the one p-channel FET 43, and the reference potential supply unit can be constituted by the one re-channel FET 44. Therefore, the alternating current generation circuit 40 (40B) can be constituted by a small number of electric elements, and the cost and the size of the liquid detecting unit 60 (603) can be reduced.

Other Modified Examples

In the first embodiment, the first electrode 35 and the second electrode 36 are manufactured with a stainless steel material having a plate bar shape, but the material of the first electrode 35 and the second electrode 36 is not limited thereto. It is sufficient that the electrodes are conductive members, a conductive member that does not corrode and does not allow rust to be mixed in the ink 34 is suitable, and the material may also be a carbon material, for example. Alternatively, the material may be a gold-plated stainless steel material having a plate bar shape. Moreover, the shape is not limited to a plate bar shape, and may be a round bar shape, a square bar shape, a coil shape or the like.

Moreover, in the first embodiment, the duty ratio of the first time period T1 and the second time period T2 of the PWM output 42 is 50%, but the duty ratio may be changed such that the second time period T2 is longer than the first time period T1. Accordingly, the time for discharging the capacitance C1 can be longer than the time for charging the capacitance C1. Therefore, because the charge stored in the capacitance C1 in the first time period T1 can be sufficiently discharged in the second time period T2, the potential of the capacitance C1 when the second time period T2 ends and the first time period T1 starts can be a certain value.

Moreover, in the first embodiment, the detection output 57 in the second time period T2 is detected to detect the ink information. However, even in the first time period T1, the value of the detection voltage V1 varies in accordance with the presence or absence and the type of the ink 34 between the first electrode 35 and the second electrode 36. Therefore, a configuration may be adopted in which the detection output 57 is detected in the first time period T1. Furthermore, a configuration is possible in which the detection output 57 in the first time period T1 and the detection output 57 in the second time period T2 are detected, and the ink information is based on the difference value therebetween.

In the embodiment of the present invention, description was given in which the ink tank 30 (the liquid container) accommodated in the ink tank unit 20 is mounted in the printer 1 by a printer vendor, and when the ink 34 no longer exists in the ink tank 30, the user of the printer 1 refills the ink tank 30 with the ink 34 from the ink injection port 32 of the ink tank 30 without replacing the ink tank 30. The application of the present invention is not limited thereto, and the ink tank 30 may be configured to be detachable from the printer 1 by the user of the printer 1, and be replaced with a new ink tank 30 when the ink 34 of the ink tank 30 is consumed. In this case, the ink tank 30 does not have the ink injection port 32, and it is sufficient that a valve that enables opening and closing of the ink supply unit 33 is provided. Moreover, it is sufficient that the first electrode 35 and the second electrode 36 of the ink tank 30 are respectively connected to the terminals 38 and 39 of the circuit board 26 when the ink tank 30 is mounted in the printer 1.

Moreover, in the embodiment and the modified examples of the present invention, description was given regarding the ink 34 stored in the ink tank 30 as an example of the liquid stored in the liquid container, and the inkjet printer 1 as an example of the liquid jetting device. However, the application scope of the present invention is not limited thereto, and the present invention can be applied to detection of liquid information regarding a conductive liquid stored in a liquid container and a liquid jetting device capable of jetting the liquid.

The entire disclosure of Japanese Patent Application No. 2015-053026, filed on Mar. 17, 2015 is expressly incorporated herein by reference.

What is claimed is:

1. A liquid detecting unit for detecting liquid information regarding a liquid stored in a liquid container, the liquid detecting unit comprising:

an alternating current generation circuit configured to generate an alternating current to be applied to the liquid, the alternating current generation circuit includes a first conductive member and a second conductive member arranged in the liquid container so as to be immersed in the liquid at least while the liquid container is filled with the liquid, a periodic signal generation unit configured to generate a predetermined periodic signal, a first resistance having one end that is connected to the first conductive member, a predetermined potential supply unit that is connected to an other end of the first resistance, connects the first conductive member to a predetermined potential that is higher than a reference potential via at least the first resistance in a first time period within one period of the predetermined periodic signal, and cuts off the connection between the first conductive member and the predetermined potential in a second time period within the one period, a reference potential supply unit including at least one electric element that is connected between the other end of the first resistance and the reference potential, and configured to connect the first conductive member to the reference potential via the first resistance, and at least one capacitance connected between the second conductive member and the reference potential;

a detection output generation unit configured to generate a detection output for detecting the liquid information based on a potential of a first connection point in the alternating current generation circuit and a potential of a second connection point in the alternating current generation circuit, the first connection point being a connection point between the first conductive member and the first resistance, and the second connection point being a connection point between the predetermined potential supply unit and the first resistance, the detection output generation unit including at least an analog switch that includes a control terminal and a pair of input/output terminals, the control terminal being connected to the second connection point, one of the input/output terminals being connected to the first connection point, the analog switch being connected or disconnected based on a potential of the second connection point, and an integration circuit, an input of the integration circuit being connected to an other of the input/output terminals, an output of the integration circuit being the detection output, the integration circuit being configured to receive an input of the potential of the first connection point during only one period selected from the first time period and the second time period, and generate the detection output based on the input of the potential of the first connection point that has been received; and a detection unit configured to detect the liquid information based on the detection output.

2. The liquid detecting unit according to claim 1, wherein the detection unit is provided with an A/D converter that performs A/D conversion on the detection output.

3. The liquid detecting unit according to claim 1, wherein the alternating current generation circuit is provided with a first terminal that is connectable to the first conductive member and a second terminal that is connectable to the second conductive member, the first conductive member is connected to the first resistance via the first terminal, and the second conductive member is connected to the capacitance via the second terminal.

4. The liquid detecting unit according to claim 1, wherein in the alternating current generation circuit, the predetermined potential supply unit is a p-channel FET that is controlled by the predetermined periodic signal and is brought into a connection state or a cut-off state, and the at least one electric element constituting the reference potential supply unit is a second resistance.

5. The liquid detecting unit according to claim 1, wherein in the alternating current generation circuit, the predetermined potential supply unit and the reference potential supply unit are constituted on different circuit boards and connected using wiring.

6. The liquid detecting unit according to claim 1, wherein in the alternating current generation circuit, a period of the predetermined periodic signal, a value of the first resistance and a value of the capacitance are determined such that in a case where the first conductive member and the second conductive member are immersed in the liquid, a current always flows from the predetermined potential to the capacitance via the first resistance and the liquid in the first time period.

7. The liquid detecting unit according to claim 1, wherein a plurality of the liquid containers are provided, the first conductive member and the second conductive member are arranged as a pair in each of the plurality of the liquid containers, and the alternating current generation circuit is provided with a selection circuit configured to selectively connect one of the first conductive members respectively arranged in the plurality of the liquid containers to the first resistance.

8. The liquid detecting unit according to claim 7, wherein in the alternating current generation circuit, a plurality of the at least one capacitor are respectively arranged corresponding to the plurality of the liquid containers, and each one of the at least one capacitances is connected between each one of the second conductive members and the reference potential.

9. A liquid jetting device capable of jetting a liquid stored in the liquid container, the liquid jetting device comprising:

the liquid detecting unit according to claim 1 for detecting liquid information regarding the liquid stored in the liquid container.

10. The liquid jetting device according to claim 9, wherein the liquid container is provided with an injection port that allows the liquid to be injected, and is capable of being refilled with the liquid.

11. The liquid jetting device according to claim 9, wherein the alternating current generation circuit is provided with a first terminal that is connectable to the first conductive member and a second terminal that is connectable to the second conductive member, and the liquid container is detachable from the liquid jetting device, and when mounted, the first conductive member is connected to the first terminal, and the second conductive member is connected to the second terminal.

12. The liquid jetting device according to claim 9, wherein the liquid is ink for printing, and the liquid jetting device is an inkjet printer provided with a print head configured to discharge the ink toward a printing medium and an ink transportation path configured to transport the ink from the liquid container to the print head.

13. The liquid detecting unit according to claim 1, wherein the detection unit is configured to detect the liquid information regardless of a level of the predetermined periodic signal while the periodic signal generation unit generates the predetermined periodic signal.

* * * * *